United States Patent [19]

Dochnahl

[11] Patent Number: 4,765,026

[45] Date of Patent: Aug. 23, 1988

[54] DOOR MECHANISM SPRING ASSEMBLY

[75] Inventor: Gaylord C. Dochnahl, Upland, Calif.

[73] Assignee: Exemplar, Inc., Ontario, Calif.

[21] Appl. No.: 744,953

[22] Filed: Jun. 17, 1985

[51] Int. Cl.[4] ..... E05D 11/08; E05F 3/00

[52] U.S. Cl. ..... 16/289; 16/306

[58] Field of Search ..... 16/78, 302, 289, 306, 16/287, DIG. 9, DIG. 10, 298, 52, 295; 267/71; 49/445

[56] References Cited

U.S. PATENT DOCUMENTS

| | | | |
|---|---|---|---|
| 819,092 | 5/1906 | Smith | 267/71 |
| 2,189,233 | 2/1940 | Vanderveld . | |
| 2,420,276 | 5/1947 | Wood | 267/71 |
| 2,450,593 | 10/1940 | Homes . | |
| 2,523,207 | 9/1950 | Fowler et al. | 16/302 |
| 2,616,716 | 11/1952 | Annis | 267/71 |
| 2,646,589 | 7/1953 | Quinn | 16/DIG. 9 |
| 2,694,318 | 11/1954 | Smith et al. | 267/71 |
| 3,112,103 | 11/1963 | Falkenberg | 267/71 |
| 3,464,161 | 9/1969 | Jonsson et al. . | |
| 3,568,365 | 3/1971 | Pernberton et al. . | |
| 3,680,259 | 8/1972 | Andresen . | |
| 4,048,695 | 9/1977 | Juilfs et al. | 16/DIG. 10 |
| 4,178,655 | 12/1979 | Little | 16/DIG. 10 |

*Primary Examiner*—M. Jordan

*Attorney, Agent, or Firm*—Sheldon & Mak

[57] ABSTRACT

A spring assembly for counterbalancing a door includes a compression spring and tension members engaging opposite ends of the spring. The tension members can be connected in a conventional door mechanism, the assembly replacing ordinary tension springs of the mechanism. The tension members and the spring are maintained in axial alignment during compression of the spring, which can be preloaded as desired. The assembly is fail-safe in that the spring is completely enclosed and the spring, if broken, continues to provide support for the door.

24 Claims, 1 Drawing Sheet

DOOR MECHANISM SPRING ASSEMBLY

BACKGROUND

Figure 2:
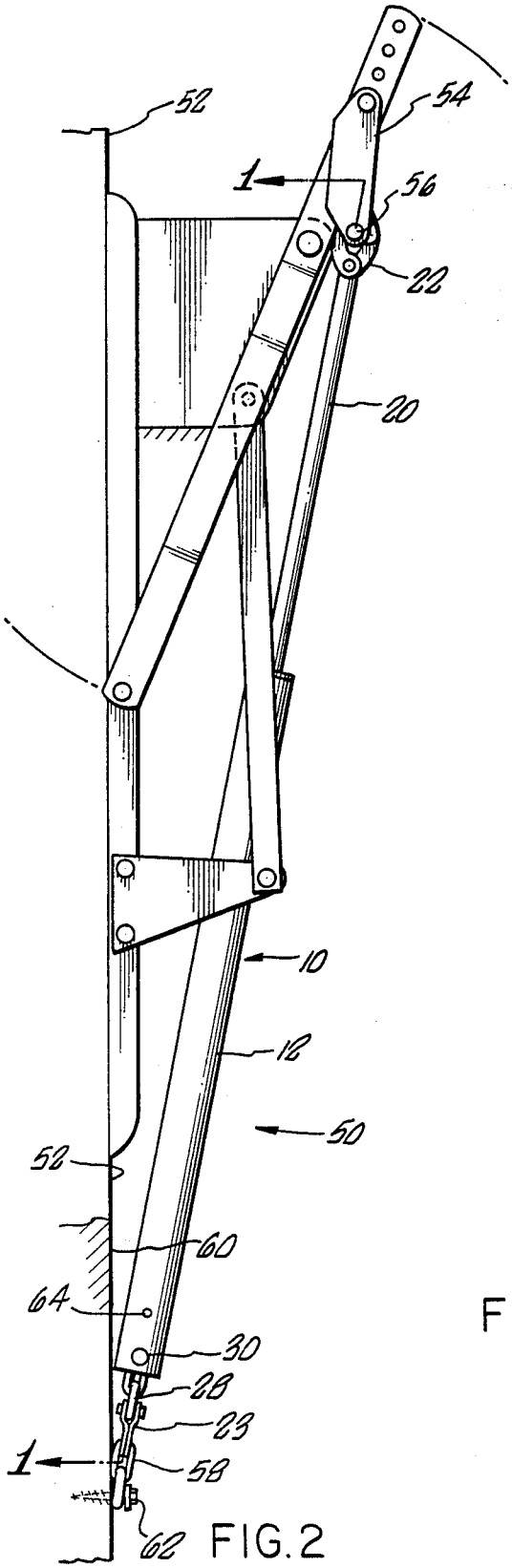

This invention relates to door mechanisms, and more particularly to counterbalancing springs for heavy doors such as found in garages and the like.

Many car garages, expecially those in residential buildings, are equipped with doors that are opened by raising them from a vertical closed position to a horizontal open position. The doors, which are quite heavy, must be counterbalanced to permit reasonably easy opening and closing.

The garage doors of the prior art, whether directly pivoted on a horizontal axis or raised by a linkage mechanism, are usually conterbalanced by long, helical, closely wound tension springs.

There are several disadvantages with the conventional tension springs of the prior art. Tension springs are not very durable. They break after a certain amount of use as a result of overloading and/or metal fatigue. The breakage occurs usually while the spring is extended from the relatively relaxed open position as the door is closed. The danger of spring breakage is aggravated by the presence of adjustment devices in most prior art door mechanisms. In an effort to increase the counterbalancing force, the spring can be adjusted to a greater extension than it can safely stand, becoming overloaded when the door is closed. When breakage occurs, pieces and small metal fragments from the broken spring can fly through air, posing a serious danger to both life and property. The end portions of the broken spring can whip around, presenting additional dangers. Also, if the spring breaks while the door is being lifted or lowered, the loss of the counterbalancing tension provided by the spring can cause the door to come crashing down, again posing grave health hazards to a person operating the door.

Moreover, most garage door spring assemblies use helical tension springs with unsightly exposed coils. The coils separate when the spring is extended. There is always the danger that objects or fingers can be caught between the coils when tension is relaxed, causing damage or physical injury.

Thus there is a need for a door counterbalancing spring that is safe and reliable, inexpensive to make and install, neat in appearance, and capable of replacing conventional springs in existing installations.

SUMMARY

The present invention is directed to a door mechanism spring assembly that meets this need. The spring assembly can provide tension between biasing points of the mechanism for counterbalancing the door, and comprises a helical compression spring, tension members engaging opposite ends of the spring, at least one of the tension members extending from its point of engagement to beyond the opposite end of the spring, means for connecting the tension members to the biasing points, and means for maintaining axial alignment of the spring with the tension members as the spring is compressed.

Preferably one tension member is a rod passing through the spring and the other is a tube enclosing the spring. The spring is thus advantageously restrained within the tube, in case of breakage. Preferably the rod, the spring, and the tube are coaxial and can easily be held in axial alignment during compression of the spring. Preferably the spring is completely enclosed so that even small fragments of the spring are prevented from escaping.

The alignment of the rod, the tube and the spring can be provided by means locating opposite ends of the spring by the rod and the tube, respectively, and providing a first guide on the tube near its pilot for locating the rod, and a second guide on the rod near its pilot, for locating the tube. Preferably the guides are non-metalic for smooth, quiet operation with low wear and friction.

Preferably the maximum and minimum deflections of the spring are limited for insuring that the spring is not overloaded and will not fail prematurely from metal fatigue.

Preferably the minimum deflection is limited by a resilient bumper for quiet operation.

In another version of the present invention, a door assembly having a raised, open position and a lowered, closed position includes a door, a mechanism for guiding the door between the open position and the closed position, a helical compression spring, tension members engaging opposite ends of the springs, at least one of the tension members extending from its point of engagement to beyond the opposite end of the spring, means for maintaining axial alignment of the spring with the tension members, and means for connecting the tension members to biasing points on the mechanism.

Thus the spring assembly of the present invention is safe and reliable in that overloading of the spring and excessive metal fatigue is prevented, and, in the unlikely event of spring failure, the door will not come crashing down and pieces from the spring will not cause injury or property damage.

The spring assembly is inexpensive to make and install in that preloading of the spring can be provided without resorting to special winding techniques, and any desired amount of preloading is possible. Also, the spring assembly can directly replace standard extension springs in a conventional door mechanism.

The spring assembly provides a neat, clean appearance in that the spring coils are hidden within the tubular housing.

DRAWINGS

Figure 1:
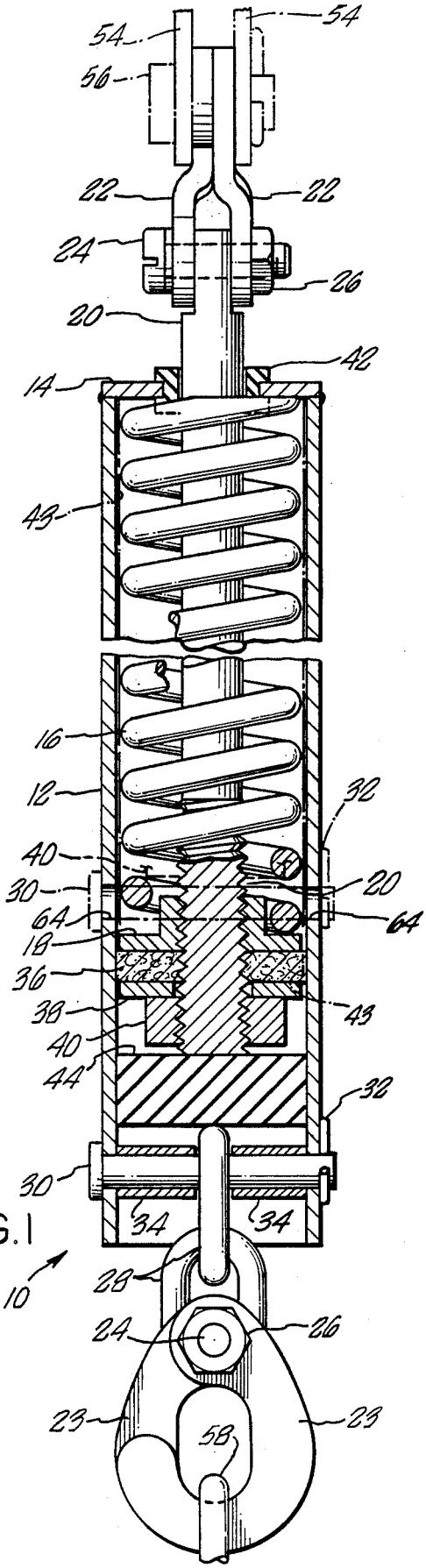

These and other features, aspects, and advantges of the present invention will become better understood with reference to the following description, appended claims, and accompanying drawings where:

FIG. 1 is a fragmentary longitudinal sectional view of the spring assembly of the present invention, the spring assembly being shown in a retracted, relaxed condition; and FIG. 2 is a fragmentary side elevational view of a garage door hinge mechanism incorporating the spring assembly of FIG. 1, located along axis 1—1, the mechanism shown in a closed position, the spring assembly being in an extended condition.

DESCRIPTION

With reference to FIG. 1, the present invention is directed to a spring assembly 10 for counterbalancing a door mechanism or the like. The spring assembly 10 comprises an elongate cylindrical tube or housing 12 having an internal flange 14 at one end thereof. The flange 14 can be welded to the housing 12, as shown in the drawings, or formed integrally therewith.

A compression spring 16 is located concentrically within the housing 12, opposite ends thereof being axially retained between the flange 14 and a shoulder nut 18. A rod 20, threadingly engaging the shoulder nut 18 and extending along the axis of the housing through the spring 16 and the flange 14, has a pair of top safety hooks 22 attached external to the housing 12 for axially coupling a tension force to the rod 20. The safety hooks 22 are fastened to the rod 20 by a clevis bolt 24 and a clevis nut 26.

A coupling chain 28 is connected to the housing 12 at the end opposite the flange 14 by an anchor pin 30 for restraining the housing 12 against the axial tension force transmitted by the rod 26. The anchor pin 30 protrudes through opposite sides of the housing 12 and is retained along its axis by a cotter pin 32. The coupling chain 28 is equipped with a pair of bottom safety hooks 23, also attached with a clevis bolt 24 and a clevis nut 26.

Preferably the coupling chain 28 is confined to a central location along the anchor pin 30 for aligning the chain 28 with the axis of the housing 12 to prevent binding of the rod 26. For this purpose, a pair of pin spacers 34 can be located on the anchor pin within the housing 12 on opposite sides of the coupling chain 28. Alternatively, the pin spacers 34 can be made integral, reinforcing the anchor pin 30.

When tension is applied through the top safety hooks 22 to the rod 20, and through the bottom safety hooks 23 to the coupling chain 28, the spring 16 is axially loaded in compression between the flange 14 and the shoulder nut 18. Thus the spring 16 is compressed to the extent that the distance increases between the top safety hooks 22 and the bottom safety hooks 23.

Preferably the spring 16 has a smaller outside diameter than the inside of the housing 12 and is piloted on the axis of the housing for preventing binding, excessive wear, and objectionable noise. Means for piloting the spring 16 can be provided by a wiper disk 36 on the rod 20, the wiper disk 36 being clamped against the shoulder nut 18 by a wiper washer 38 and a wiper nut 40. The wiper disk 36 being larger in diameter than the spring 16, the shoulder nut 18 and the wiper washer 38, slides in the housing 12, guiding the rod 20 in the housing 12.

Additionally, the rod 20 is piloted at the flange 14. A grommet or bushing 42 can be installed in the flange 14 for slidingly locating the rod 20. Thus the spring 16 can be piloted on its inside diameter by the bushing 42 and the shoulder nut 18. If necessary, the center portion of the spring 16, between the flange 14 and the shoulder nut 18, will be guided in contact with the housing 12. In this manner, the housing 12, the spring 16, and the rod 20 are maintained in axial alignment during compression of the spring 16.

Preferably the wiper disk 36 and the bushing 42 are made of non-metallic materials for reducing wear and friction, and providing smooth, quiet operation.

Alternatively, a non-metallic coating or lining 43 can be provided for the housing 12. The wiper disk 36 can then be metallic, integral with the shoulder nut 18 and the wiper washer 38. In this configuration, the advantages of non-metallic sliding contact are extended to the guiding of the center portion of the spring 16.

Preferably a resilient bumper 44 is provided between the rod 20 and the coupling chain 28 for preventing harmful contact therebetween when the spring 16 is released from a compressed state.

With reference to FIG. 2, the spring assembly 10 can be included in a conventional garage door hinge mechanism 50. The mechanism 50 supports one side of a door 52, shown in a vertical or closed position. A link 54 of the mechanism 50, having a clevis pin 56 therethrough, is coupled by the clevis pin 56 to the top safety hooks 22 of the spring assembly 10 for biasing the door 52 upwardly toward an open position. An anchor chain 58, fastened to a stationary structural member 60 by an anchor screw 62, is connected to the bottom safety hooks 23 for axially restraining the housing 12. The clevis pin 56 and the anchor screw 62 function as biasing or connection points of the mechanisms 50, these points moving apart as the door 52 is lowered from the open position to the closed position.

Installation of the spring assembly 10 into the mechanism 50 can be facilitated by temporarily preloading the spring 16 to an intermediate position, thereby extending the rod 20 and separating the safety hooks 22 and 23. For this purpose, auxiliary holes 64 can be provided in the housing 12 for an additional anchor pin 30 and associated cotter pin 32, the additional anchor pin 30 holding the rod 20 in the partially extended position. Thus, the spring assembly 10 can be easily connected to the mechanism 50 with no tension applied between this clevis pin 56 and the anchor screw 62 when the door 52 is in a raised, or partially raised position. The door 52 can then be lowered, separating the rod 20 from the additional anchor pin 30, so that the pin can easily be removed, completing the installation.

An important feature of the present invention is that compressive deformation of the spring 16 can be no greater than that causing contact between the adjacent coils of the spring. Thus torsional and shear loading of the coils are limited by this "solid height condition" of the spring.

Preferably the spring 16 is wound such that compression to the solid height does not result in overloading of the spring. Thus the reliability of the spring assembly 10 is improved over conventional tension springs that are subject to overloading and consequent failure when they are extended beyond a rated length.

Another feature of the present invention is that for a given coil diameter and wire size, the spring 16, being compressively loaded, can carry a greater load than a tension spring, due to the way that the axial and torsional coil stresses interact. Thus for a given load carrying capacity, the spring 16 can be made smaller, lighter and less expensive to produce than conventional extension springs.

Another feature of the present invention is that in the unlikely event of a spring failure, the load is carried by adjacent coils in contact, precluding complete failure of the spring assembly 10. Thus the door can not come crashing down on a person attempting to operate the door when the failure occurred. Neither would the end portions whip around because they are restrained by the housing 12 and/or the rod 20.

Preferably the spring 16 is completely enclosed by the housing 12 for preventing broken fragments from escaping in case of spring failure. The housing 12 provides the further advantages of preventing objects from being caught between coils of the spring 16 and providing a neat, clean appearance of the spring assembly 10.

Preferably the bumper 44 limits the travel of the rod 20 in the direction of unloading the spring 16, effecting a preloading of the spring 16. The preloading is adjustable according to the position of the shoulder nut 18 and the wiper nut 40 on the rod 20. This preloading, in contrast with conventional tension springs, is only limited by the design of the spring 16 and the length of the housing 12. Thus the spring assembly 10 can be assembled with a desired preload before it is incorporated in the door mechanism 50, reducing the work required to complete the installation. Tension springs on the other hand, can be only slightly preloaded by introducing twist during winding, and the preloading is adjustable only to the extent that the door mechanism 50 is adjusted to prevent coil-to-coil contact.

A further advantage of the bumper 44 is that the fatigue life of the spring can be controlled by the preloading described above, because the maximum coil loading is limited by the solid height condition as also described above. This is because the fatigue life is a function of both maximum and mimimum cyclic stress levels, both being controlled in the present invention. Thus a high minimum fatigue life can now be provided, a life that can only be extended, not reduced, by subsequent adjustment of the door mechanism 50 external to the spring assembly 10.

Moreover, the resilience of the bumper 44 advantageously provides gradual unloading of the spring 16 as the rod 20 comes into contact with the bumper 44. Thus the full range of travel of the rod 20 within the housing 12 can be used without noisy or jerky operation of the door mechanism 50.

The preloading is also adjustable, above a predetermined minimum, by substituting for the bumper 44 another of greater thickness. Alternatively, the bumper 44 can be spaced apart from the coupling chain 28; moreover, alternative locations can be provided for the anchor pin 30 in the housing 12.

Another important feature of the present invention is that the spring assembly 10 can directly replace the ordinary tension springs of the conventional door mechanism 50. An inspection of many popular garage door hinge mechanisms revealed that the maximum spring travel required between open and closed door positions is about 17.5 inches. In practice, the spring assembly 10 can be configured as the functional equivalent of popular tension spring designs by adjusting the length of the anchor chain 58 and the preloading of the spring 12, facilitating replacement of the tension springs in existing door mechanisms.

A prototype of the spring assembly 10 was constructed according to the following parameters:

(a) Spring 16—83.1 coils (2 inactive) of 0.283 in. diameter oil tempered chrome vanadium steel, 2.095 in. outside diameter, 48.5 in. length;

(b) Housing 12—2.375 in. outside diameter, 0.065 wall thickness steel tube, 43.5 in. long.

(c) Rod 20—0.625 in. dia, 18.5 in. travel from a minimum distance of 46.5 inches between the top safety hooks 22 and the bottom safety hooks 23.

In tests of the prototype assembly, a maximum tension of 476 pounds was produced at the point of coil-to-coil contact of the spring 16, the tension decreasing linearly to a preloaded condition of 125 pounds at the point of contact between the rod 20 and the bumper 44.

In comparison, a conventional tension spring of 2 in. diameter and 30 in. length developed a maximum tension of 200 pounds when elongated 14 inches from a coil-to-coil preload of 80 pounds.

A pair of the prototype assemblies was installed in a conventional door mechanism 50 supporting a 350 lb. double-width wooden garage door. The tests showed that the door was sufficiently counter balanced to remain stationary, unattended, over a wide range of positions between open and closed.

For lightweight aluminum and/or single-width wooden garage doors, another version of the spring assembly 10 can be constructed according to the following parameters:

(a) Spring 16—76.3 coils (2 inactive) of 0.218 inches diameter oil tempered chrome vanadium steel, 1.875 outside diameter, 41.1 inch length;

(b) Housing 12—2.125 inches outside diameter, 0.065 wall thickness steel tube, 36 inches long.

(c) Rod 20—0.625 inches diameter, 17.9 in. travel from a minimum distance of 39 inches between the top safety hooks 22 and the bottom safety hooks 23.

It is expected that this version will produce a maximum tension of 240 pounds at the point of coil-to-coil contact of the spring 16, the tension decreasing linearly to a preloaded condition of about 64 pounds at the point of contact between the rod 20 and the bumper 44.

Although the present invention has been described in considerable detail with regard to certain versions thereof, other versions are possible. For example, a plurality of rods, in tension, can be used in place of the tubular housing 12. These rods can be located either outside or inside of the coils of the spring 16. Additionally, the rod 20 can be augmented or replaced by a tubular member on which the spring 16 is guided. Moreover, the housing 12 can be provided with slots or holes for inspection, oiling and the like. Therefore, the spirit and scope of the appended claims should not necessarily be limited to the description of the versions contained herein.

What is claimed is:

1. A spring assembly for counterbalancing a door mechanism having a pair of biasing connection points moving apart relative to each other as the door is lowered from an open position into a closed position, the assembly comprising:

(a) a helical compression spring having a first end and a second end;

(b) first and second tension members respectively engaging the first and second ends of the spring, the first tension member extending from the first end of the spring to beyond the second end of the spring;

(c) means for maintaining axial alignment of the spring with the tension members;

(d) means for limiting the maximum and minimum deflection of the spring;

(e) means for connecting the tension members to the connection points of the door mechanism; and (f) means for temporarily limiting the deflection of the spring to not less than an intermediate deflection greater than the minimum deflection for facilitating installation of the assembly without tension being applied by the spring to the connection points, wherein the installed spring is axially compressed as the door is lowered into the closed position.

2. The assembly of claim 1 wherein the first tension member comprises a rod passing through the spring and the second tension member comprises a tube surrounding the spring.

3. The assembly of claim 2 wherein the rod, the spring, and the tube are coaxial.

4. The assembly of claim 2 wherein the spring is completely enclosed.

5. The assembly of claim 4 wherein the internal flange comprises a first non-metallic guide for the first tension member and the external flange comprises a second non-metallic guide for the second tension member for smooth operation.

6. The assembly of claim 2 wherein the means for limiting the maximum and minimum deflection of the spring comprises means for limiting relative axial movement between the rod and the tube for preloading of the spring in compression.

7. The assembly of claim 6 including adjustment means for adjusting the position of the limiting means for adjusting the minimum compressive deflection of the spring.

8. The assembly of claim 6 in which the limiting means comprises a resilient bumper for providing gradual unloading of the spring as the door is lowered.

9. The assembly of claim 2 wherein the means for aligning comprises:

(a) means on the first tension member for locating the first end of the spring;

(b) means on the second tension member for locating the second end of the spring;

(c) an internal flange on the second tension member located proximate to the second end of the spring, the internal flange slidingly locating the first tension member; and (d) an external flange on the first tension member proximate to the first end of the spring, the external flange slidingly locating the second tension member.

10. The assembly of claim 9 wherein the internal flange comprises a first non-metallic guide for the first tension member and the second tension member comprises a second non-metallic guide for the external flange.

11. The assembly of claim 1 wherein the means for limiting comprises coil-to-coil contact of the spring limiting the maximum deflection, and a bumper for preventing relative axial movement between the first tension member and the second tension member beyond a position corresponding to a predetermined minimum compressive deflection of the spring.

12. The assembly of claim 1 including a resilient bumper for providing gradual unloading of the spring as the door is lowered.

13. The spring assembly of claim 1 wherein the means for limiting the maximum and minimum deflection of the spring comprises means for limiting the relative axial movement between the tension members for setting a predetermined minimum compressive loading of the spring.

14. The spring assembly of claim 13 including adjustment means for adjusting the position of the limiting means for adjusting the minimum compressive loading of the spring.

15. The spring assembly of claim 1 wherein the spring and the second tension member are enclosed within an outside diameter of not more than about 2.375 inches, and the tension members have respective door connection ends engaging the connecting means, the door connection ends being spaced apart not more than about 56.5 inches in the raised position of the door, and being capable of moving apart at least about 17.5 inches between the raised position and the lowered position, the spring being capable of producing a tension of at least about 240 pounds between the connection points in the lowered position.

16. The assembly of claim 15 wherein the spring is capable of producing a tension of at least about 476 pounds between the connection points in the lowered position of the door.

17. The assembly of claim 15 wherein outside diameter of the spring and the second tension member is not more than about 2.125 inches, the door connection ends being spaced apart not more than about 39 inches in the raised position, and being capable of moving apart at least about 17.9 inches between the raised position and the lowered position of the door.

18. The assembly of claim 1 wherein the temporary limiting means comprises a removable pin member transversely engaging the second tension member for preventing relative axial movement between the first tension member and the second tension member beyond a position corresponding to a predetermined intermediate axial compression of the spring.

19. A counterbalanced door assembly comprising:

(a) a door;

(b) a mechanism for guiding the door between a raised, open position and a lowered, closed position, the mechanism having a pair of connection points, the connection points moving apart relative to each other as the door is lowered into the closed position;

(c) a helical compression spring having a first end and a second end;

(d) first and second tension members respectively engaging the first and second ends of the spring, the first tension member extending from the first end of the spring to beyond the second end of the spring;

(e) means for maintaining axial alignment of the spring with the tension members; and (f) means for connecting the tension members to the connection points of the door mechanism, wherein the installed spring is axially compressed as the door is lowered into the closed position, and wherein the spring and the second tension member are enclosed within an outside diameter of not more than about 2.375 inches, and the tension members have respective door connection ends engaging the connecting means, the door connection ends being spaced apart not more than about 56 inches in the raised position, and being capable of moving apart at least about 17.5 inches between the raised position and the lowered position of the door, the spring being capable of producing a tension of at least about 240 pounds between the connection points in the lowered position.

20. The assembly of claim 19 further comprising means for temporarily limiting the deflection of the spring to not less than an intermediate deflection greater than the minimum deflection for facilitating installation of the assembly without tension being applied by the spring to the connection points.

21. The assembly of claim 20 wherein the temporary limiting means comprises a removable pin member transversely engaging the second tension member for preventing relative axial movement between the first tension member and the second tension member beyond a position corresponding to a predetermined intermediate axial compression of the spring.

22. A counterbalanced door assembly comprising:

(a) a door;

(b) a mechanism for guiding the door between a raised, open position and a lowered, closed position, the mechanism having a pair of connection points, the connection points moving apart relative to each other as the door is lowered into the closed position;

(c) a helical compression spring having a first end and a second end;

(d) first and second tension members respectively engaging the first and second ends of the spring, the first tension member extending from the first end of the spring to beyond the second end of the spring;

(e) means for maintaining axial alignment of the spring with the tension members; and (f) means for connecting the tension members to the connection points of the door mechanism, wherein the installed spring is axially compressed as the door is lowered into the closed position, and wherein the tension members have respective door connection ends engaging the connecting means, the door connection ends being spaced apart not more than about 56.5 inches in the raised position, and being capable of moving apart at least about 17.5 inches between the raised position and the lowered position of the door.

23. The door assembly of claim 22 wherein the second tension member comprises a tube surrounding the spring, the tube having an outside diameter of not more than about 2.375 inches, the spring being capable of producing a tension of at least about 476 pounds between the connection points in the lowered position.

24. A counterbalanced door assembly comprising:

(a) a door;

(b) a mechanism for guiding the door between a raised, open position and a lowered, closed position, the mechanism having a pair of connection points, the connection points moving apart relative to each other as the door is lowered into the closed position;

(c) a helical compression spring having a first end and a second end;

(d) first and second tension members respectively engaging the first and second ends of the spring, the first tension member extending from the first end of the spring to beyond the second end of the spring;

(e) means for maintaining axial alignment of the spring with the tension members; and (f) means for connecting the tension members to the connection points of the door mechanism, wherein the installed spring is axially compressed as the door is lowered into the closed position, and wherein the second tension member comprises a tube surrounding the spring, the tube having an outside diameter of not more than about 2.125 inches, and the tension members have respective door connection ends engaging the connecting means, the door connection ends being spaced apart not more than about 39 inches in the raised position, and being capable of moving apart at least about 17.9 inches between the raised position and the lowered position of the door, the spring being capable of producing a tension of at least about 240 pounds between the connection points in the lowered position.

* * * * *